US007691435B2

(12) United States Patent
Keller et al.

(10) Patent No.: US 7,691,435 B2
(45) Date of Patent: Apr. 6, 2010

(54) THERMAL CONTROL COATINGS

(75) Inventors: John G. Keller, Rancho Palos Verdes, CA (US); Robert M. Moy, Redondo Beach, CA (US); Jane R. Felland, Palos Verdes, CA (US)

(73) Assignee: The Boeing Company

( * ) Notice: Subject to any disclaimer, the term of this patent is extended or adjusted under 35 U.S.C. 154(b) by 287 days.

(21) Appl. No.: 11/463,809

(22) Filed: Aug. 10, 2006

(65) Prior Publication Data

US 2008/0038454 A1 Feb. 14, 2008

(51) Int. Cl.

| | |
|---|---|
| ***C03C 17/34*** | (2006.01) |
| ***C03C 17/36*** | (2006.01) |
| ***G01K 11/14*** | (2006.01) |
| ***G02B 5/22*** | (2006.01) |
| ***G02F 1/01*** | (2006.01) |
| ***G02F 1/19*** | (2006.01) |

(52) U.S. Cl. ..... 427/162; 428/432; 428/428; 428/698; 428/701; 428/704; 428/702; 427/248.1; 204/192.1; 204/192.38; 244/158; 252/408.1

(58) Field of Classification Search ..... 359/580; 206/714; 355/406; 503/227; 427/64, 162, 427/248.1; 428/212, 432, 428, 696, 701, 428/704; 204/192.1, 192.38; 244/158; 252/408.1
See application file for complete search history.

(56) References Cited

U.S. PATENT DOCUMENTS 5,061,874 A * 10/1991 Hecq et al. ..... 313/478
2004/0155154 A1* 8/2004 Topping ..... 244/158 R

OTHER PUBLICATIONS

Haddad, E. et al., "Dynamically—variable thin-film smart radiator device", MPB Communications Inc., 4th Round Table on Micro/Nano Technologies for Space, 20 pages, May 20-22, 2003.
Tazawa, M. et al., "IR properties of SiO deposited on $V_{1-x}W_xO_2$ thermochromic films by vacuum evaporation", Thin Solid Films, vol. 375, pp. 100-103, (2000).

* cited by examiner

*Primary Examiner*—David R Sample
*Assistant Examiner*—Michael B Nelson
(74) *Attorney, Agent, or Firm*—Klintworth & Rozenblat IP LLC

(57) ABSTRACT

The invention discloses differing embodiments of thermal control coatings, spacecraft components having coatings, and methods for controlling the temperature of a component. In one embodiment, a thermal control coating under the invention may include one or more thermochromic multi-layer coatings and one or more solar rejection multi-layer coatings. The thermal control coating may have one or more transition temperatures at which the solar absorptance of the solar rejection coating substantially stays the same, while a thermal emittance of the thermochromic coating substantially changes.

28 Claims, 7 Drawing Sheets

| | Material | Thickness (nm) |
|---|---|---|
| | Si | 250.0 |
| | $VO_2$ | 10.5 |
| | Si | 235.8 |
| | $VO_2$ | 12.7 |
| | Si | 49.5 |
| | $VO_2$ | 14.3 |
| | Si | 35.7 |
| | $VO_2$ | 15.9 |
| | Si | 28.3 |
| | $VO_2$ | 17.9 |
| | Si | 23.7 |
| | $VO_2$ | 20.4 |
| | Si | 20.4 |
| | $VO_2$ | 23.6 |
| | Si | 17.9 |
| | $VO_2$ | 28.2 |
| | Si | 15.9 |
| | $VO_2$ | 35.4 |
| | Si | 14.2 |
| | $VO_2$ | 48.9 |
| | Si | 12.8 |
| | $VO_2$ | 95.7 |
| | Si | 11.2 |
| | Al | 200.0 |

| | Material | Thickness (nm) |
|---|---|---|
| Region 1 | $MgF_2$ | 40.0 |
| | ZnS | 24.5 |
| | $MgF_2$ | 40.0 |
| | ZnS | 24.5 |
| | $MgF_2$ | 40.0 |
| | ZnS | 24.5 |
| | $MgF_2$ | 40.0 |
| | ZnS | 24.5 |
| Region 2 | $MgF_2$ | 68.0 |
| | ZnS | 41.7 |
| | $MgF_2$ | 68.0 |
| | ZnS | 41.7 |
| | $MgF_2$ | 68.0 |
| | ZnS | 41.7 |
| | $MgF_2$ | 68.0 |
| | ZnS | 41.7 |
| Region 3 | $MgF_2$ | 89.0 |
| | ZnS | 54.6 |
| | $MgF_2$ | 89.0 |
| | ZnS | 54.6 |
| | $MgF_2$ | 89.0 |
| | ZnS | 54.6 |
| | $MgF_2$ | 89.0 |
| | ZnS | 54.6 |

| | Material | Thickness (nm) |
|---|---|---|
| Region 4 | $MgF_2$ | 125.0 |
| | ZnS | 76.7 |
| | $MgF_2$ | 125.0 |
| | ZnS | 76.7 |
| | $MgF_2$ | 125.0 |
| | ZnS | 76.7 |
| | $MgF_2$ | 125.0 |
| | ZnS | 76.7 |
| Region 5 | $MgF_2$ | 170.0 |
| | ZnS | 104.3 |
| | $MgF_2$ | 170.0 |
| | ZnS | 104.3 |
| | $MgF_2$ | 170.0 |
| | ZnS | 104.3 |
| | $MgF_2$ | 170.3 |
| | ZnS | 104.3 |
| Region 6 | $MgF_2$ | 230.0 |
| | ZnS | 141.1 |
| | $MgF_2$ | 230.0 |
| | ZnS | 141.1 |
| | $MgF_2$ | 230.0 |
| | ZnS | 141.1 |
| | $MgF_2$ | 230.0 |
| | ZnS | 141.1 |

FIG. 4

THERMAL CONTROL COATINGS

BACKGROUND OF THE INVENTION

There are existing methods and devices for thermal control in one or more components of a spacecraft. Some of these methods and devices utilize heat pipes such as constant conductance heat pipe, and variable conductance heat pipe in order to maintain thermal control. Other methods and devices utilize thermal control surfaces such as mirrors, paints, coatings, and multi-layer insulation blankets. Still other methods and devices utilize heaters, mechanical louvers, and phase change materials.

These thermal control tools may be grouped into local or electronic-level control, and subsystem or spacecraft-level control. For instance, phase change materials may be used at the electronic-level, and constant conductance heat pipe may be used to spread the heat of the electronics. The rest of the methods and devices referred to may be considered subsystem or spacecraft-level control.

Thermal radiators made from mirrors, and thermal paints or coatings may be sized to reject heat, but may require heaters to maintain minimum temperature during cold periods or inactive times. Many commercial satellite allocate between 400 to 500 watts for heater power to maintain electronics above minimum operating temperatures. Multi-layer thermal blankets may be used to isolate and/or to minimize heat loss. Satellite thermal control may utilize a combination of all of these thermal control tools.

Mechanical louvers usually are not used in satellite thermal control due to reliability, operational limitation, and weight issues. Variable conductance heat pipe may use temperature-activated thermal control. However, there may be power issues, weight costs, and/or increased system design complexity as the variable conductance heat assembly may require heating and cooling for its condensers to control the pipe's conductance.

A thermal control device or method is needed which may solve one or more problems in one or more of the existing methods and/or devices for controlling thermal conditions.

SUMMARY OF THE INVENTION

In one aspect of the invention, a thermal control coating is provided which comprises a combination of at least one thermochromic multi-layer coating and at least one solar rejection multi-layer coating.

In another aspect, the invention discloses a method of controlling a temperature of a component. In one step, a coating is provided. The coating comprises at least one solar rejection multi-layer coating and at least one thermochromic multi-layer coating. In another step, the coating is put on at least one of a component and a surface.

In a further aspect of the invention, a spacecraft component with a coating is provided. The coating includes a combination of at least one thermochromic multi-layer coating comprising alternating layers of Vanadium Dioxide and Silicon, and at least one solar rejection multi-layer coating comprising alternating layers of Magnesium Fluoride and Zinc Sulfide.

These and other features, aspects and advantages of the invention will become better understood with reference to the following drawings, description and claims.

BRIEF DESCRIPTION OF THE DRAWINGS

FIG. 4 depicts a table showing, for one embodiment under the invention, the thicknesses of alternating layers of Magnesium Fluoride and Zinc Sulfide in different regions of the solar rejection multi-layer coating;

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
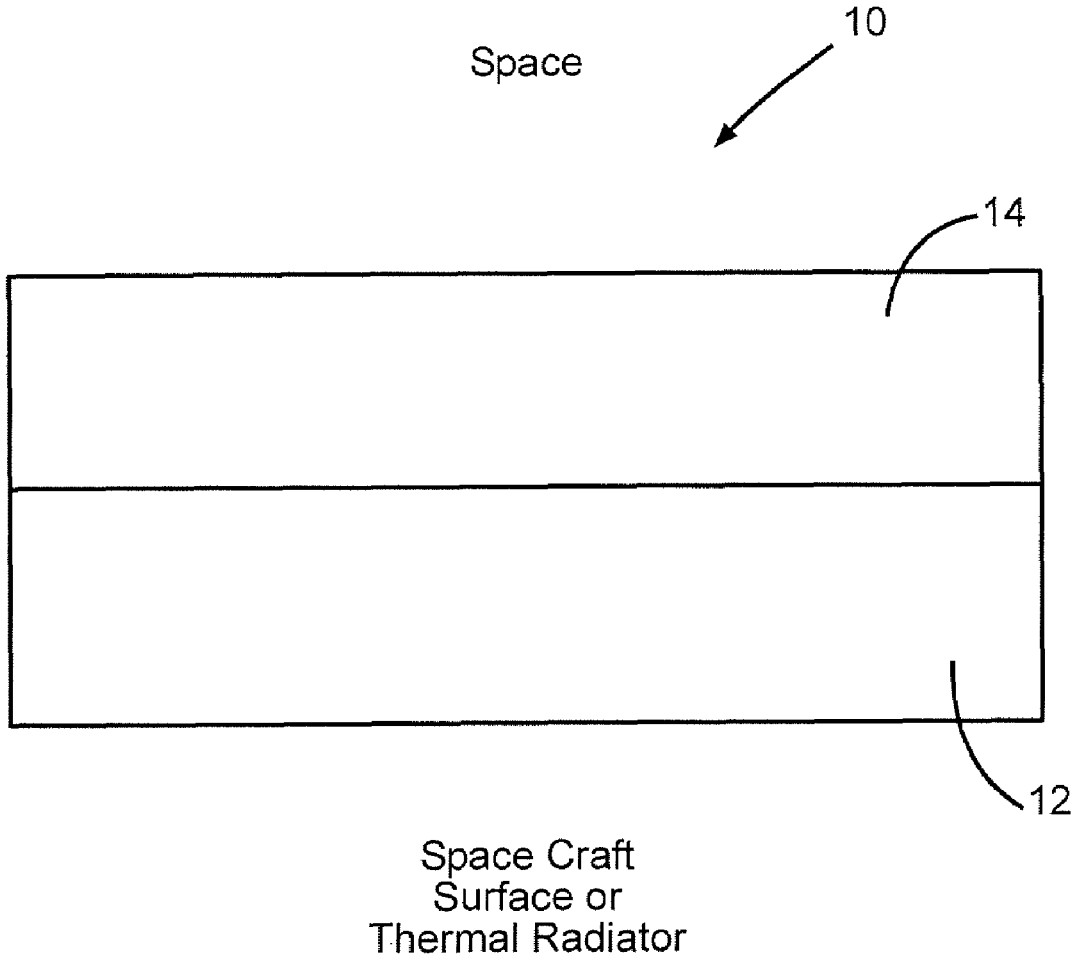
FIG. 1 depicts one embodiment of a thermal control coating under the invention.

In one embodiment of the invention, as shown in FIG. 1, a thermal control coating 10 is provided. The thermal control coating 10 may cover, or be adapted to cover, one or more portions, surfaces, or components of a spacecraft. In other embodiments, the thermal control coating may be used in an assortment of other applications, such as in airplanes, and other non-aeronautical applications, such as a "sky" radiator for residential cooling. The thermal control coating 10 may be adapted to have specific thermal emittance and/or solar absorption properties at particular temperatures depending on what properties are needed for the particular application of use. For purposes of this application, the term "thermal control coating" may be a coating that has the appropriate spectral properties to control the thermal radiation into and out of the item of interest; the term "solar absorption" may be the absorption of solar energy (which in one embodiment may be at a wavelength from 0.25 to 2.5 Microns); the term "solar rejection" may be the reflection of solar energy (which in one embodiment may be at a wavelength from 0.25 to 2.5 Microns); and the term "thermal emittance" may be the absorption or emission of thermal radiation (which in one embodiment may be at a wavelength from 2.5 to 25 Microns).

Figures 2, 3:
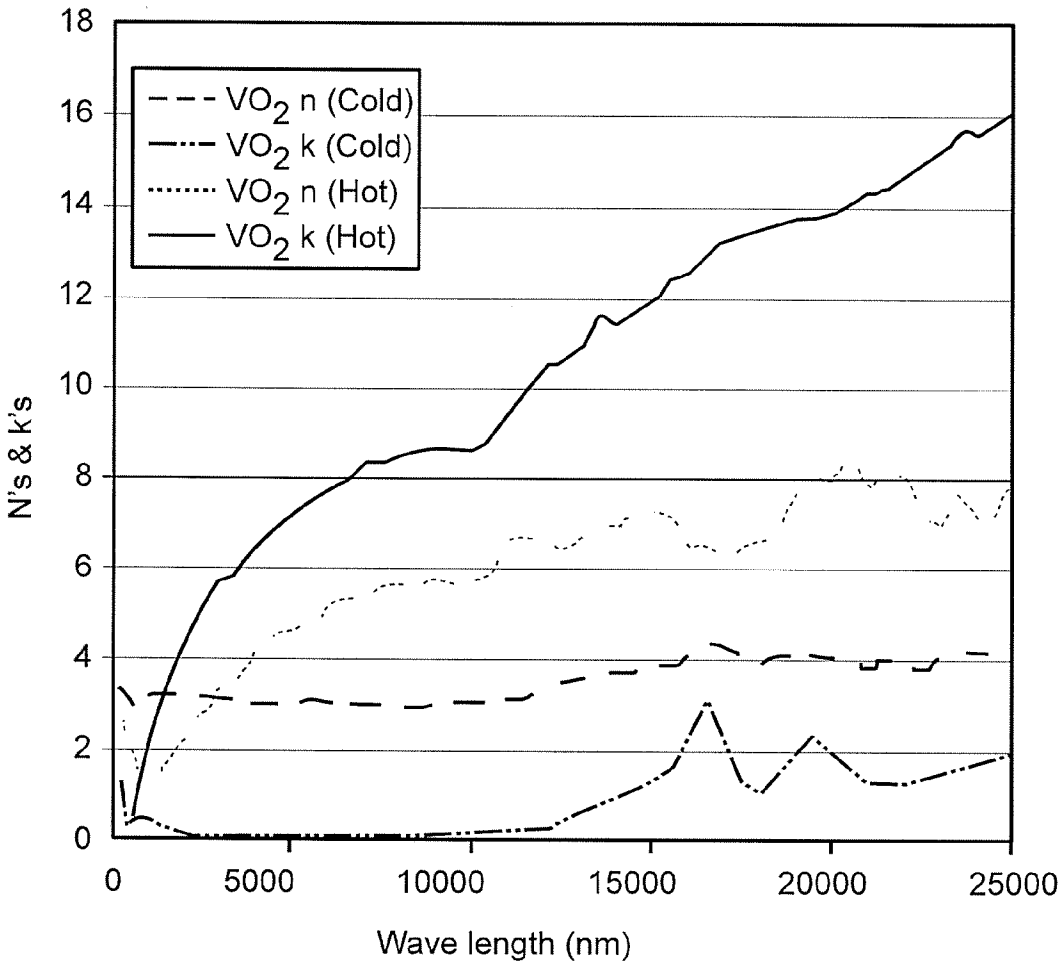
FIG. 2 depicts a table showing, for one embodiment of the invention, the thicknesses of alternating layers of Vanadium Dioxide and Silicon, and the thickness of a layer of Aluminum, in the thermochromic multi-layer coating.
FIG. 3 depicts the optical properties of Vanadium Dioxide below and above a transition temperature.

The thermal control coating 10 may comprise at least one thermochromic multi-layer coating 12 and at least one solar rejection multi-layer coating 14. The thermochromic multi-layer coating 12 may comprise layers of Vanadium Dioxide ($VO_2$) and Silicon (Si), in addition to one or more layers of Aluminum (Al). The layers may alternate. In other embodiments, varying configurations and/or varying layers of differing substances may be used. FIG. 2 contains a table depicting, for one embodiment, the thicknesses of the alternating layers of Vanadium Dioxide and Silicon, and the thickness of a layer of Aluminum, in the thermochromic multi-layer coating 12. In differing embodiments, varying thickness layers may be utilized.

Vanadium Dioxide may undergo a semiconductor to metal phase transition at a transition temperature at 68 degrees Celsius. FIG. 3 shows the optical properties of Vanadium Dioxide below and above the transition temperature. The index of refraction is represented by n and the extinction coefficient is represented by k.

The solar rejection multi-layer coating 14 may comprise layers of Magnesium Fluoride ($MgF_2$) and Zinc Sulfide (ZnS). The layers may alternate. In other embodiments, varying configurations and/or varying layers of differing substances may be used. Some of these alternative substances may include $BiF_3$, $CaF_2$, $CeO_2$, $CeF_3$, $NA_3ALF_6$, $GdF_3$, $HfO_2$, $LaF_3$, $PbCl_2$, $PbF_2$, $MgF_2$, $SmF_3$, $Sc_2O_3$, NaF, ZnS, and/or $ZrO_2$. FIG. 4 contains a table depicting, for one embodiment, the thicknesses of the alternating layers of Magnesium Fluoride and Zinc Sulfide in different regions of the solar rejection multi-layer coating 14. In differing embodiments, varying thickness layers may be utilized.

In one embodiment, an outer layer of the thermal control coating 10 may comprise alternating layers of Magnesium Fluoride and Zinc Sulfide, while an inner layer may comprise alternating layers of Vanadium Dioxide and Silicon. In differing embodiments, the configuration of the layers may altered, and/or differing substances may be used.

The thermal control coating 10 may have a transition temperature at which a thermal emittance of the thermochromic multi-layer coating 12 and/or a solar absorptance of the solar rejection multi-layer coating 14 substantially changes. In one embodiment, at the transition temperature, a thermal emittance of the thermochromic multi-layer coating 12 may substantially change, but a solar absorptance of the solar rejection multi-layer coating 14 may substantially stay the same. The transition temperature may be approximately 68 degrees Celsius. In another embodiment, the transition temperature may be approximately room temperature and/or around 30 degrees Celsius. In other embodiments, varying transition temperatures may be utilized.

Figure 5:
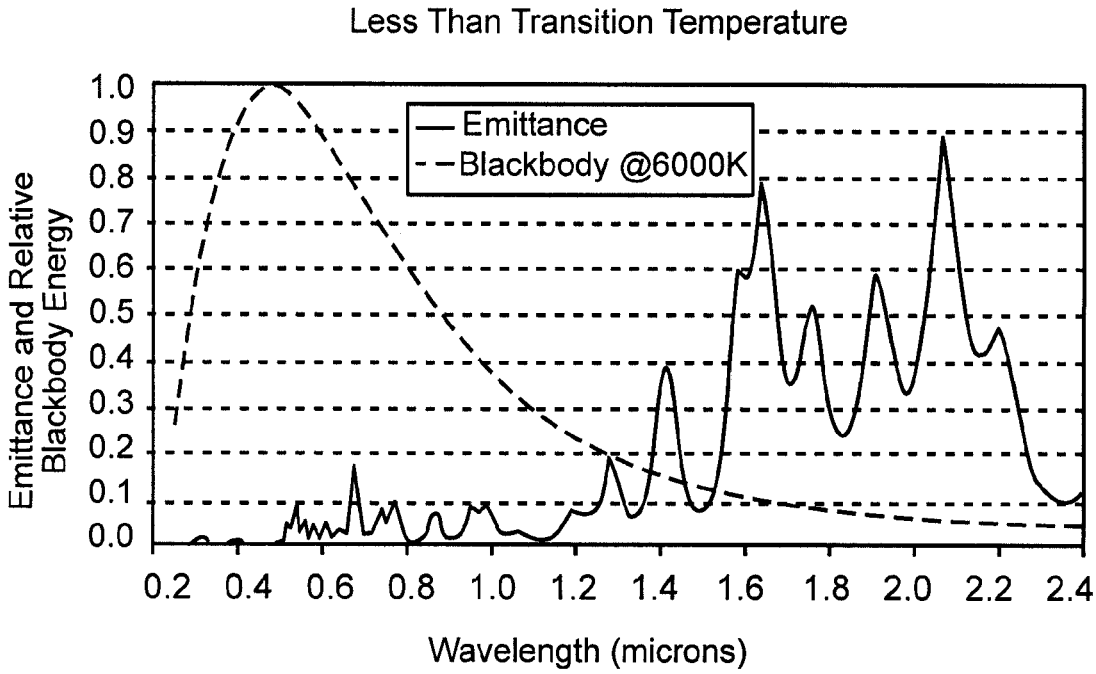
FIG. 5 depicts, for below a transition temperature, one embodiment under the invention of the solar rejection properties of a solar rejection multi-layer coating made of alternating layers of Magnesium Fluoride and Zinc Sulfide.
Figure 6:
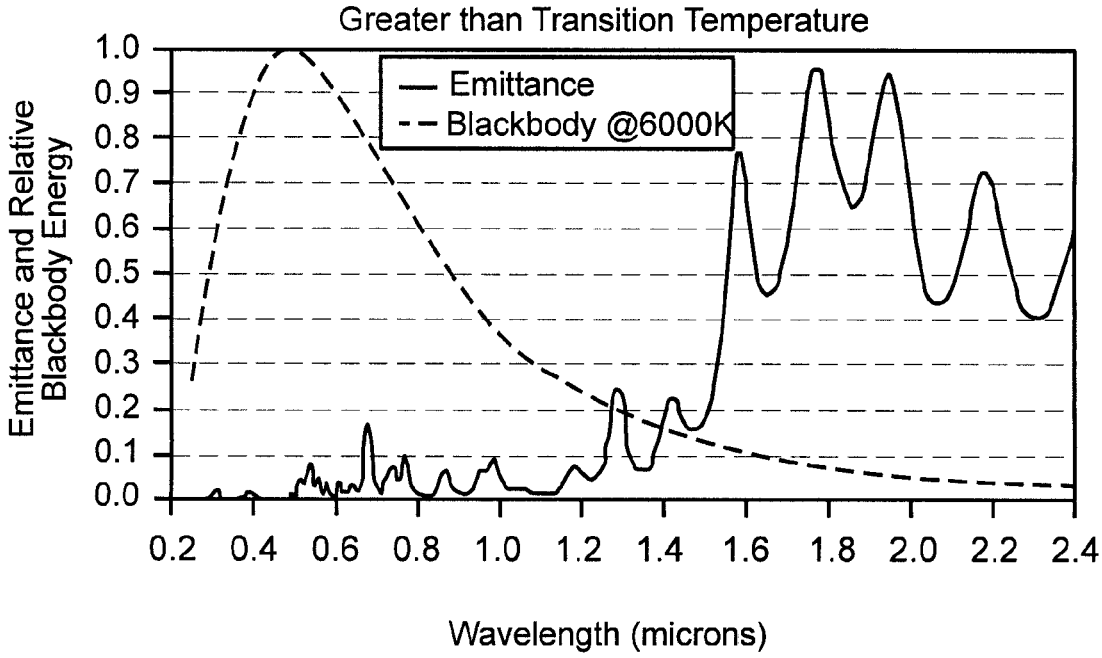
FIG. 6 depicts, for above a transition temperature, the solar rejection properties of the solar rejection multi-layer coating of FIG. 5.

FIGS. 5 and 6 depict, for below a 68 degree Celsius transition temperature and above a 68 degree Celsius transition temperature respectively, one embodiment of the solar rejection properties of a solar rejection multi-layer coating 14 made of alternating layers of Magnesium Fluoride and Zinc Sulfide. The solar rejection coating 14 may be reflective and opaque in the solar region (which may be from 0.25 to 2.5 Microns), and transparent in the infrared region (which may be from 2.5 to 25 Microns). As a result, the solar absorption properties of the thermal control coating 10 may be substantially independent of temperature and/or the materials it is deposited upon.

In one embodiment, the solar rejection multi-layer coating 14 may be substantially opaque and reflective at the solar region and may be substantially transparent in the infrared region. The solar region may be in the range of 0.25 to 2.5 Microns, and the infrared region may be substantially in the range of 2.5 to 25 Microns. In other embodiments, one or more of the visibility properties of the solar rejection multi-layer coating 14, and the solar region and infrared region wavelength ranges may vary.

Figure 7:
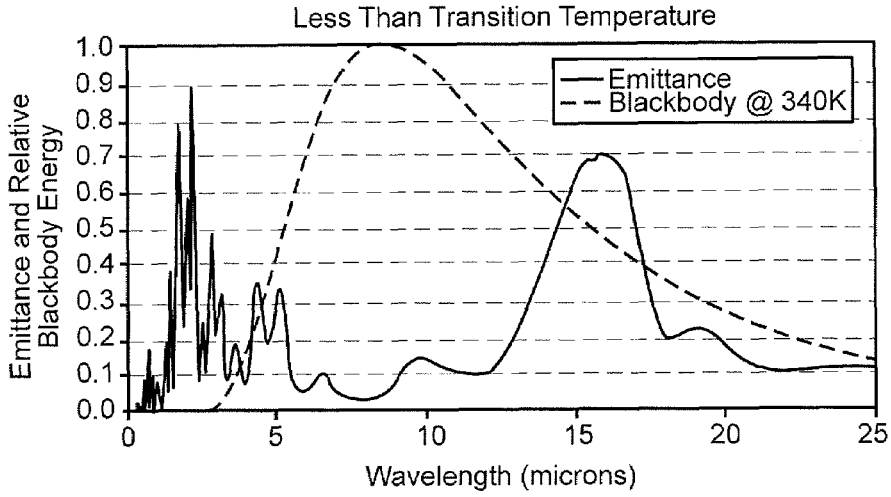
FIG. 7 depicts, for below a transition temperature, one embodiment under the invention of the thermal emittance properties of a thermochromic multi-layer coating made of alternating layers of Vanadium Dioxide and Silicon.
Figure 8:
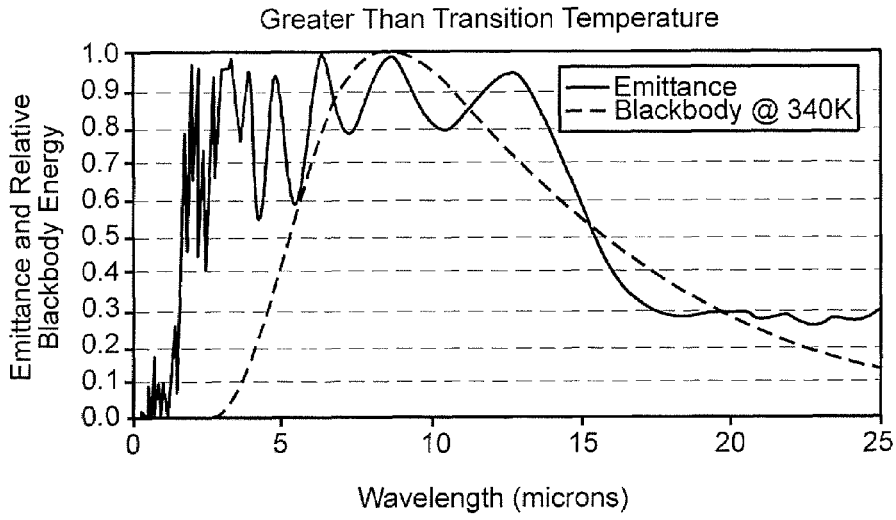
FIG. 8 depicts, for above a transition temperature, the thermal emittance properties of the thermochromic multi-layer coating of FIG. 7.

FIGS. 7 and 8 depict, for below a 68 degree Celsius transition temperature and above a 68 degree Celsius transition temperature respectively, one embodiment of the thermal emittance properties of a thermochromic multi-layer coating 12 made of alternating layers of Vanadium Dioxide and Silicon. The thermochromic coating 12 may be optimized to have high emittance above the transition temperature and low emittance below the transition temperature based on the blackbody radiation at the transition temperature.

A thermal emittance of the thermochromic multi-layer coating 12 may be substantially in the range of 0.05 to 0.15 below the transition temperature, and substantially in the range of 0.8 to 1.0 above the transition temperature. The thermal emittance may be the fraction of the total blackbody energy emitted at the surface temperature. A solar absorptance of the solar rejection multi-layer coating 14 may stay substantially in the range of 0.05 to 0.15 both above and below the transition temperature. The solar absorptance may be the fraction of the total solar energy absorbed at the surface. In another embodiment, the thermal emittance of the thermochromic multi-layer coating 12 may be approximately 0.1 below the transition temperature and approximately 0.8 above the transition temperature, while the solar absorptance of the solar rejection multi-layer coating 14 may be approximately 0.1 both above and below the transition temperature. In other embodiments, the thermal emittance of the thermochromic multi-layer coating 12, and the solar absorptance of the solar rejection multi-layer coating 14, may vary.

Figure 9:
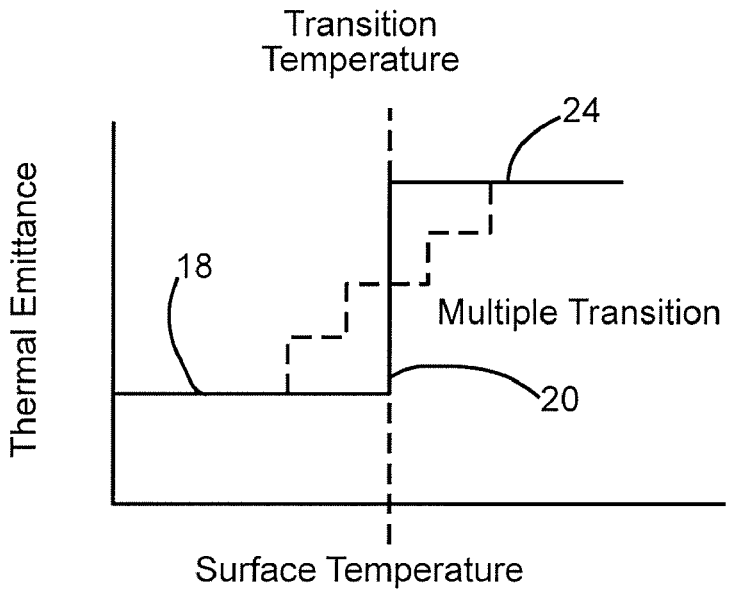
FIG. 9 depicts a graph of the thermal emittance properties of one embodiment under the invention of a thermal control coating.
Figure 10:
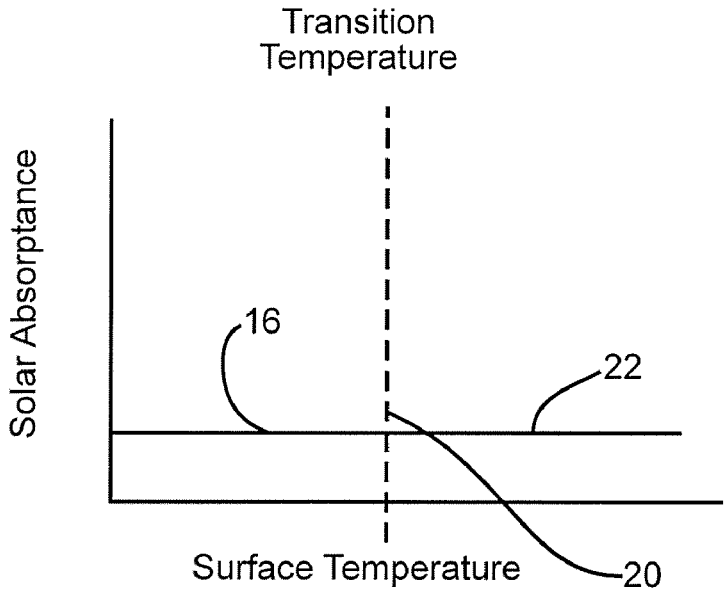
FIG. 10 depicts a graph of the solar absorption properties of the thermal control coating of FIG. 9.

As shown in FIGS. 9 and 10, depicting graphs of the thermal emittance and solar absorptance respectively, by designing the thermal control coating 10 so that it displays low solar absorptance 16 and low thermal emittance at 18 temperatures below the transition temperature 20, and so that it displays low solar absorptance 22 and high thermal emittance 24 at temperatures above the transition temperature 20, the thermal control coating 10 may act as a passive temperature-activated thermal control with no electrical power requirements and minimum weight impact on the apparatus it is utilized on. In such manner, the thermal control coating 10 may provide thermal emittance switching depending on temperature, while maintaining low solar absorptance. At low temperatures, the thermal control coating 10 may display substantially similar properties as a polished aluminum surface having low solar absorptance and low thermal emittance to minimize heat loss. At high temperatures, the thermal control coating 10 may display substantially similar properties as a silver-quartz mirror surface having low solar absorptance and high thermal emittance to maximize heat rejection and minimize heating from the sun.

The implementation of the thermal control coating 10 may eliminate the need for the use of devices and/or systems to regulate temperature. In such manner, the invention may reduce one or more problems in one or more prior art systems such as the reduction of cost, the reduction of weight, the reduction of the use of electricity, the reduction of unreliability, and/or one the reduction of one or more other problems.

In another embodiment, the thermal control coating 10 may have a plurality of transition temperatures at which a thermal emittance of the thermochromic multi-layer coating 12, and/or a solar absorptance of the solar rejection multi-layer coating 14, substantially changes. By having a multitude of transition temperatures, varying thermal emittance and solar absorptance properties may be achieved at varying temperatures. In one embodiment having multiple transition temperatures, at each transition temperature, a solar absorptance of the solar rejection multi-layer coating 14 may substantially stay the same, while a thermal emittance of the thermochromic multi-layer coating 12 may substantially change.

In order to change the transition temperature(s) of the thermal control coating 10, one or more substances may be added to the thermal control coating 10 in an alloying and/or doping process. The added substances may comprise at least one of Tungsten (W), Iron (Fe), and/or Molybdenum (Mo). In other embodiments, varying substances in varying amounts may be utilized to change the transition temperature(s) of the thermal control coating 10. In such manner, the transition temperature(s) of the thermal control coating may be fine-tuned to a specific application.

Figure 11:
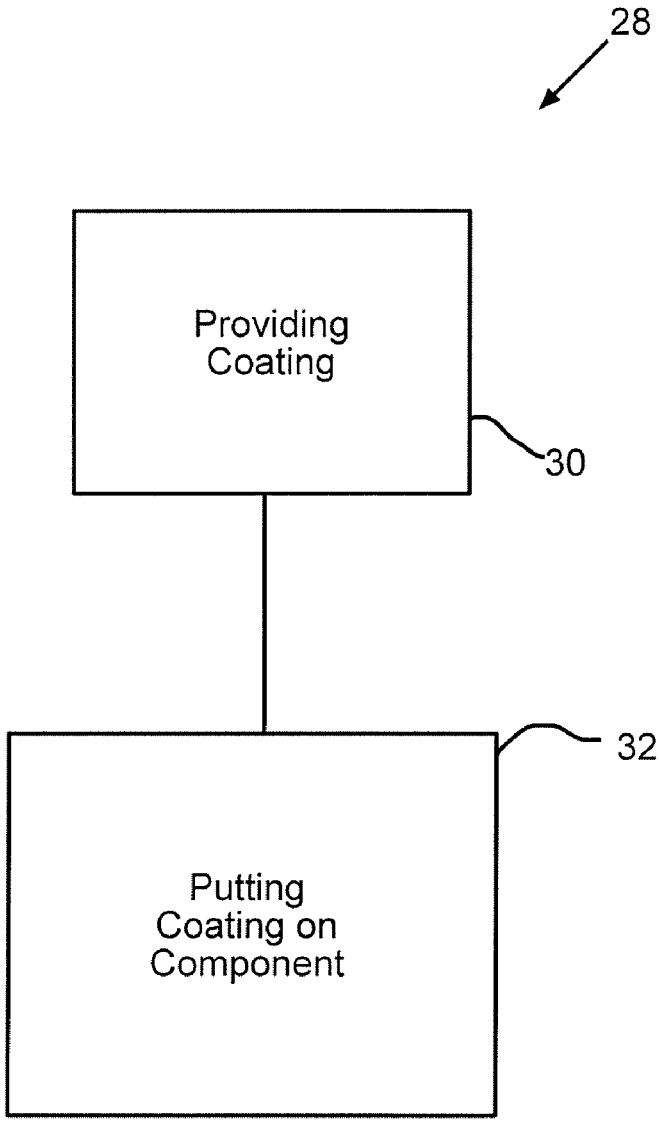
FIG. 11 depicts one embodiment of a method under the invention for controlling the temperature of a component.

FIG. 11 depicts one embodiment of a method 28 for controlling the temperature of a component. The method may include the step 30 of providing a coating comprising at least one solar rejection multi-layer coating, and at least one thermochromic multi-layer coating. The coating may comprise any of the thermal control coating 10 embodiments disclosed herein. The method may further include the step 32 of putting the coating on a component. The component may comprise a spacecraft component and/or a spacecraft surface. In other embodiments, the component may be used in other non-spacecraft applications. The method may also include the step of a temperature changing to both above and below a transition temperature. A solar absorptance of the solar rejection multi-layer coating 14 may substantially stay the same both above and below the transition temperature, while a thermal emittance of the thermochromic multi-layer coating 12 may substantially change above and below the transition temperature.

It should be understood, of course, that the foregoing relates to exemplary embodiments of the invention and that modifications may be made without departing from the spirit and scope of the invention as set forth in the following claims.

We claim:

1. A thermal control coating comprising a combination of at least one thermochromic multi-layer coating and at least one solar rejection multi-layer coating, wherein a thermal emittance of the thermal control coating over a wavelength range of 2.5 Microns to 25 Microns is in a range of 0.05 to 0.15 below a transition temperature, and in the range of 0.8 to 1.0 above the transition temperature, and a solar absorptance of the thermal control coating over the wavelength range of 0.25 Microns to 2.5 Microns is in the range of 0.05 to 0.15 both above and below the transition temperature.

2. The thermal control coating of claim 1 wherein said thermochromic multi-layer coating comprises layers of Vanadium Dioxide and Silicon.

3. The thermal control coating of claim 2 wherein said layers of Vanadium Dioxide and Silicon alternate.

4. The thermal control coating of claim 2 wherein said thermochromic multi-layer coating further comprises one or more layers of Aluminum.

5. The thermal control coating of claim 1 wherein said solar rejection multi-layer coating comprises layers of Magnesium Fluoride and Zinc Sulfide.

6. The thermal control coating of claim 2 wherein said solar rejection multi-layer coating comprises layers of Magnesium Fluoride and Zinc Sulfide.

7. The thermal control coating of claim 6 wherein an outer layer of said thermal control coating comprises alternating layers of Magnesium Fluoride and Zinc Sulfide, and an inner layer comprises alternating layers of Vanadium Dioxide and Silicon.

8. The thermal control coating of claim 1 wherein said transition temperature is approximately 68 degrees Celsius.

9. The thermal control coating of claim 1 wherein said solar absorptance is approximately 0.1 both above and below said transition temperature, and said thermal emittance is approximately 0.1 below said transition temperature and approximately 0.8 above said transition temperature.

10. The thermal control coating of claim 1 wherein said transition temperature is at least one of room temperature and around 30 degrees Celsius.

11. The thermal control coating of claim 1 wherein said thermal control coating has a plurality of transition temperatures at which at each of said transition temperatures, the solar absorptance of the solar rejection multi-layer coating substantially stays the same, but the thermal emittance of the thermochromic multi-layer coating substantially changes.

12. The thermal control coating of claim 1 wherein said coating covers at least one of a portion of a component, a spacecraft component, and a spacecraft surface.

13. The thermal control coating of claim 1 wherein said thermal control coating further comprises at least one substance for changing said transition temperature.

14. The thermal control coating of claim 13 wherein said substance comprises at least one of Tungsten, Iron, and Molybdenum.

15. The thermal control coating of claim 1 wherein said solar rejection multi-layer coating is substantially opaque and reflective in a solar region and is substantially transparent in an infrared region.

16. The thermal control coating of claim 15 wherein said solar rejection multi-layer coating is substantially opaque and reflective in the wavelength range of 0.25 to 2.5 Microns, and is substantially transparent in the wavelength range of 2.5 to 25 Microns.

17. A method of controlling a temperature of a component comprising:

providing a coating, wherein said coating comprises at least one solar rejection multi-layer coating and at least one thermochromic multi-layer coating, wherein a thermal emittance of the coating, over a wavelength range of 2.5 Microns to 25 Microns is in a range of 0.05 to 0.15 below a transition temperature, and in the range of 0.8 to 1.0 above the transition temperature, and a solar absorptance of the coating over the wavelength range of 0.25 Microns to 2.5 Microns is in the range of 0.05 to 0.15 both above and below the transition temperature; and putting said coating on at least one of a component and a surface.

18. The method of claim 17 wherein said component comprises a spacecraft component.

19. The method of claim 17 wherein said thermochromic multi-layer coating comprises layers of Vanadium Dioxide and Silicon.

20. The method of claim 19 wherein said layers of Vanadium Dioxide and Silicon alternate.

21. The method of claim 19 wherein said thermochromic multi-layer coating further comprises one or more layers of Aluminum.

22. The method of claim 17 wherein said solar rejection multi-layer coating comprises layers of Magnesium Fluoride and Zinc Sulfide.

23. The method of claim 19 wherein said solar rejection multi-layer coating comprises layers of Magnesium Fluoride and Zinc Sulfide.

24. The method of claim 23 wherein an outer layer of said coating comprises alternating layers of Magnesium Fluoride and Zinc Sulfide, and an inner layer comprises alternating layers of Vanadium Dioxide and Silicon.

25. A spacecraft component which includes a coating, wherein said coating includes a combination of at least one thermochromic multi-layer coating comprising alternating layers of Vanadium Dioxide and Silicon, and at least one solar rejection multi-layer coating comprising alternating layers of Magnesium Fluoride and Zinc Sulfide, wherein a thermal emittance of the coating over a wavelength range of 2.5 Microns to 25 Microns is in a range of 0.05 to 0.15 below a transition temperature, and in the range of 0.8 to 1.0 above the transition temperature, and a solar absorptance of the coating over the wavelength range of 0.25 Microns to 2.5 Microns is in the range of 0.05 to 0.15 both above and below the transition temperature.

26. The method of claim 17 wherein said solar rejection multi-layer coating is substantially opaque and reflective in a solar region and is substantially transparent in an infrared region.

27. The method of claim 26 wherein said solar rejection multi-layer coating is substantially opaque and reflective over the wavelength range of 0.25 to 2.5 Microns, and is substantially transparent over the wavelength range of 2.5 to 25 Microns.

28. The method of claim 17 wherein the transition temperature is 68 degrees Celsius.

* * * * *